US006121561A

United States Patent [19]

Sweeney

[11] Patent Number: 6,121,561

[45] Date of Patent: Sep. 19, 2000

[54] HERMETICALLY SEALED ELECTRICAL SWITCH

[75] Inventor: Scott Sweeney, Naugatuck, Conn.

[73] Assignee: Tri-Tech, Inc., Waterbury, Conn.

[21] Appl. No.: 09/395,117

[22] Filed: Sep. 14, 1999

[51] Int. Cl.[7] ..... H01H 9/04

[52] U.S. Cl. ..... 200/302.2; 200/302.1

[58] Field of Search ..... 200/16 R–16 D, 200/400, 405, 407, 408, 410, 417, 431, 434, 435, 438, 440, 441, 449, 451, 462, 463, 467, 520, 302.1, 302.2, 341, 345

[56] References Cited

U.S. PATENT DOCUMENTS

| | | | |
|---|---|---|---|
| 2,777,910 | 1/1957 | Jordan et al. | 200/67 |
| 2,854,536 | 9/1958 | Beer | 200/67 |
| 3,244,849 | 4/1966 | Ravret et al. | 200/168 |
| 3,987,266 | 10/1976 | Betz | 200/302 |
| 4,540,864 | 9/1985 | Krasser et al. | 200/302.2 |
| 4,652,706 | 3/1987 | Rao et al. | 200/67 D |
| 4,941,254 | 7/1990 | Davis | 29/622 |
| 5,016,140 | 5/1991 | Prestel et al. | 361/400 |
| 5,164,561 | 11/1992 | Schaeffeler et al. | 200/302.2 |
| 5,181,603 | 1/1993 | Mori et al. | 200/302.1 |
| 5,211,471 | 5/1993 | Rohrs | 362/206 |
| 5,352,858 | 10/1994 | Keck | 200/302.1 |
| 5,382,767 | 1/1995 | Takano et al. | 200/531 |
| 5,626,222 | 5/1997 | Aguilera | 200/305 |

*Primary Examiner*—Michael Friedhofer
*Attorney, Agent, or Firm*—John H. Crozier

[57] ABSTRACT

In a preferred embodiment, a hermetically sealed electrical switch, including: a housing; a bellows having a closed end and an open end, with the open end sealingly attached to the housing such that a first volume defined by interior surfaces of the housing and exterior surfaces of the bellows is hermetically sealed from external environment and such that a second volume defined at least in part by interior surfaces of the bellows is in communication with the external environment; switching apparatus disposed in the first volume; switch actuator apparatus at least partially disposed in the second volume; and wherein depression of the switch actuator apparatus against the closed end of the bellows causes the closed end of the bellows to press against and actuate the switching apparatus.

13 Claims, 3 Drawing Sheets

HERMETICALLY SEALED ELECTRICAL SWITCH

BACKGROUND OF THE INVENTION

1. Field of the Invention

The present invention relates to electrical switches generally and, more particularly, but not by way of limitation, to a novel hermetically sealed electrical switch having a high cycle life.

2. Background Art

Electrical switches are widely used to make and/or break electrical contacts. In some applications, aircraft and spacecraft, for example, it is desirable that the switching components be isolated from the surrounding environment.

The basic problem which the designer of any sealed switch must address is that switching motion must take place across a some type of sealing member in order to actuate the switch. Some attempts to fabricate such switches involve the use of sealing members such as silastic (rubber) boots, bellows, hoses, or diaphragms, with the required switching motion causing the sealing member to stretch or flex.

Some attempts to provide sealed switches include the following:

U.S. Pat. No. 2,777,910, issued Jan. 15, 1957, to Jordan et al., and titled HERMETICALLY SEALED SWITCH, describes a sealed snap switch in which the actuator operates across a diaphragm.

U.S. Pat. No. 2,854,536, issued Sep. 30, 1958, to Beer, and titled SNAP-ACTION ELECTRIC SWITCHES, describes a sealed snap switch having a bellows-sealed actuator, the bellows including an internal spring to cause it to return to an extended position.

U.S. Pat. No. 4,540,864, issued Sep. 10, 1985, to Krasser et al., and titled ACTUATING FIXTURE FOR PUSH-PULL SWITCH, describes an actuator for a push-pull switch which includes a "hose" (bellows) seal.

U.S. Pat. No. 4,654,706, issued Mar. 24, 1987, to Rao et al., and titled DOUBLE-POLE SWITCH CONSTRUCTION, describes a sealed switch which is activated by pressing buttons formed on a flexible rubberized cover.

U.S. Pat. No. 5,164,561, issued Nov. 17, 1992, to Schaeffeler et al., and titled PUSH BUTTON SWITCH HAVING SEALING BELLOWS, describes a switch having an actuator which is sealed with a bell shaped bellows.

U.S. Pat. No. 5,382,767, issued Jan. 17, 1995, to Takano et al., and titled PUSH-BUTTON SWITCH, describes a switch having a bell shaped bellows disposed over an actuator button.

U.S. Pat. No. 5,626,222, issued May 6, 1997, to Aguilera, and titled FORCE CONTROLLABLE SHIELDED MECHANICAL SWITCH ACTUATORS, describes a switch having an actuator which is formed internally of and integrally with a vertical metal bellows, the actuator depending from the upper wall of the bellows.

None of the foregoing switches, except for the one described in the '910 patent, is considered to a hermetically sealed switch and that one employs a flexing thin plate diaphragm. This provides a satisfactory seal, but the flexing thin plate diaphragm limits the mechanical life of the switch.

No known switch is presently offered that guarantees over 100,000 switching cycles.

Accordingly, it is a principal object of the present invention to provide a hermetically sealed electrical switch that has long electrical and mechanical life.

It is a further object of the invention to provide such a switch that meets stringent leak rate standards.

It is an additional object of the invention to provide such a switch that can be economically manufactured.

It is another object of the invention to provide such a switch that meets military standard MIL-S-8805, Enclosure 5, which states that an electrical switch construction must have a leak rate of no greater than $1\times10^{-8}$ atm.cc/sec.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a hermetically sealed electrical switch, comprising: a housing; a bellows having a closed end and an open end, with said open end sealingly attached to said housing such that a first volume defined by interior surfaces of said housing and exterior surfaces of said bellows is hermetically sealed from external environment and such that a second volume defined at least in part by interior surfaces of said bellows is in communication with said external environment; switching means disposed in said first volume; switch actuator means at least partially disposed in said second volume; and wherein depression of said switch actuator means against said closed end of said bellows causes said closed end of said bellows to press against and actuate said switching means.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
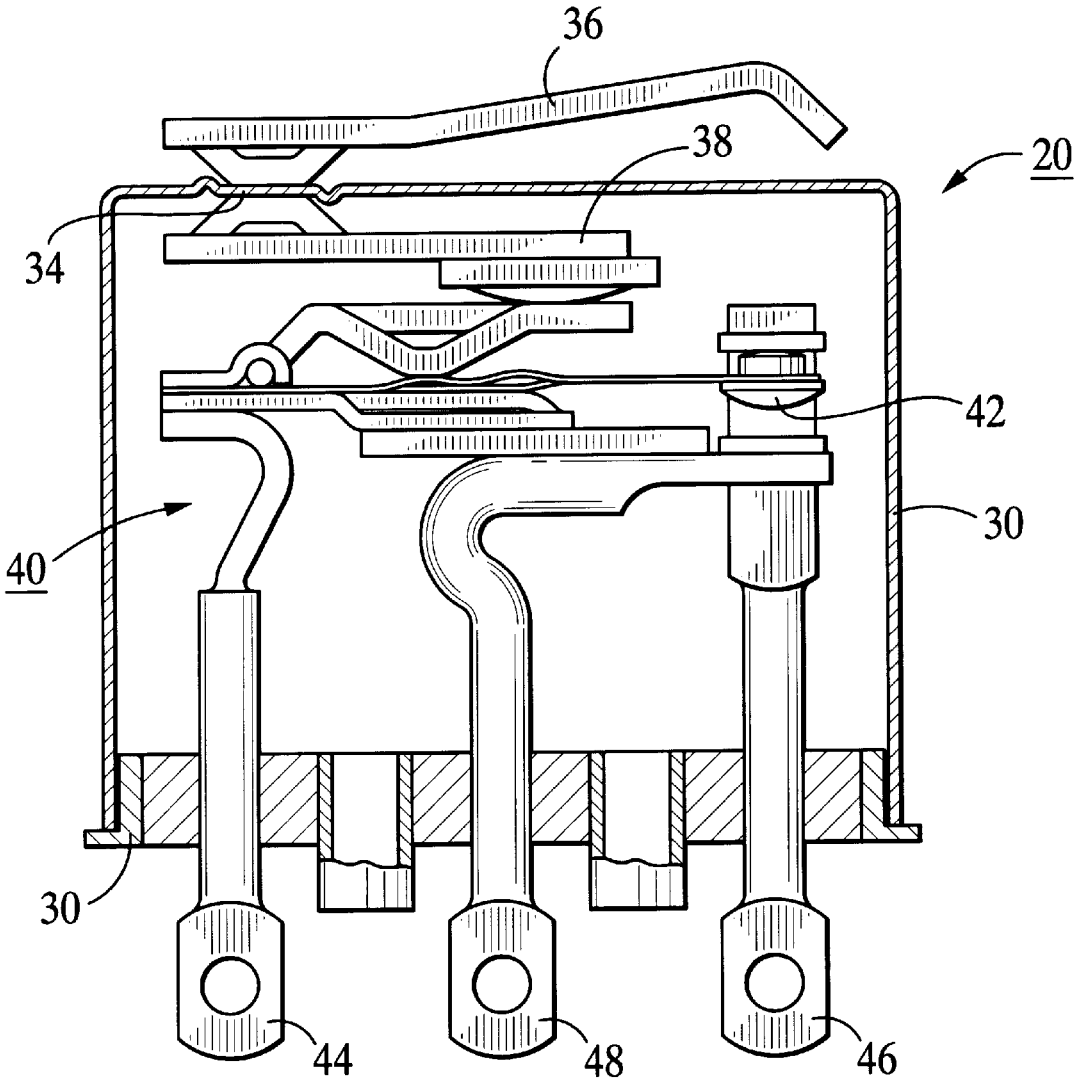
FIG. 1 (Prior Art)
FIG. 1 is a side elevational view, partially in cross-section, of one type of conventional hermetically sealed electrical switch.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates one conventional type of hermetically sealed electrical switch, generally indicated by the reference numeral 20.

Switch 20 includes an inverted cup-shaped housing 30, sealed by soldering to a metallic base plate 32, and having a wobble portion 34 formed in the upper surface thereof. An external actuator lever 36 is welded through wobble portion 34 to an internal actuator lever 38, so that pressing downwardly on the distal end of the external actuator lever causes the distal end of the internal actuator to press downwardly on a switch mechanism disposed in switch 20, the switch mechanism being generally indicated by the reference numeral 40. This action, in turn, causes a switch element 42 to move from a position connecting a common terminal 44 to a normally closed terminal 46, the position shown on FIG. 1, to a position connecting the common terminal to normally open terminal 48. Switch mechanism 40, as shown, is a single throw, double pole, momentary contact switch. While switch 20 provided adequate hermetic sealing, the life thereof was limited by the resulting fatigue of wobble portion 34 in the upper surface of housing 30.

Figure 3:
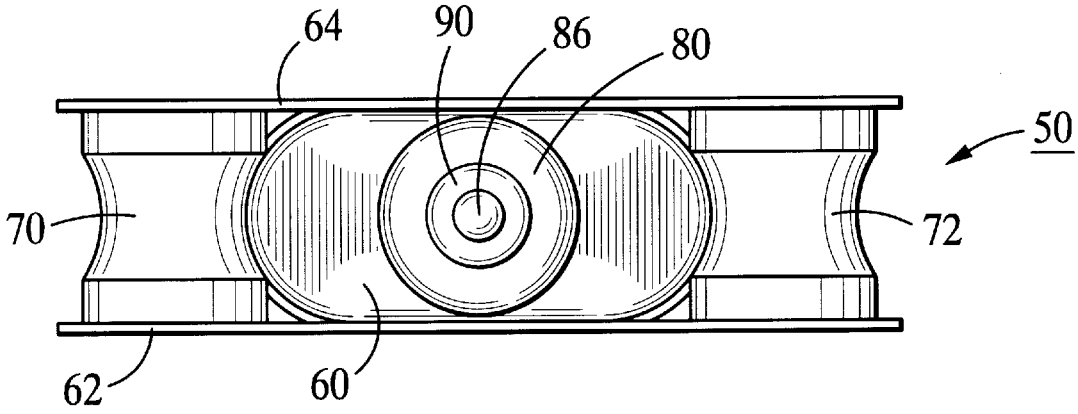
FIG. 3 is a top plan view of the switch of FIG. 2.
Figure 2:
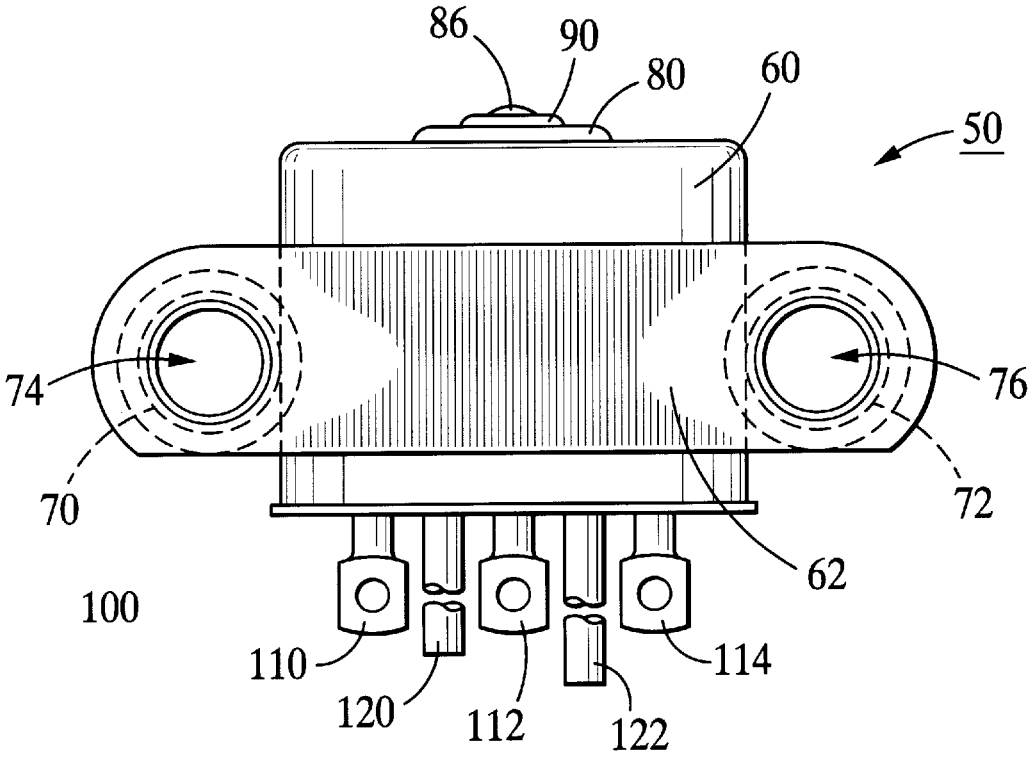
FIG. 2 is a side elevational view of a hermetically sealed electrical switch constructed according to the present invention.

FIGS. 2 and 3 illustrates a hermetically sealed electrical switch, constructed according to the present invention, and generally indicated by the reference numeral 50.

Switch 50 includes a drawn nickel-silver housing 60 with flattened sides and rounded ends (FIG. 3) and having elongated mounting brackets 62 and 64 extending horizontally along the flattened sides of the housing. Extending horizontally between the distal ends of mounting brackets 62 and 64 are mounting tubes 70 and 72 (FIG. 3) having openings 74 and 76 (FIG. 2) defined therethrough to accept mounting hardware (not shown) for mounting switch 50 to a desired suitable surface (not shown). Of course, the mounting arrangement shown is FIGS. 2 and 3 is by way of example only and any suitable mounting arrangement may be provided, the exact mounting arrangement forming no part of the present invention.

A cylindrical, nickel-silver cover plate 80 extends through the top of housing 60 and is sealed to the housing by means of continuous soldering around the portion of the cover plate extending through the top of the housing. A ceramic actuation button 86 extends through cover plate 80 and is arranged for manual depression downwardly with respect to the cover plate. An annular overtravel stop 90 is formed integrally with cover plate 80 and surrounds actuation button 86 to limit the degree to which the actuation button can be manually depressed, by engagement of a finger of a user (not shown) with the overtravel stop.

A base plate assembly 100 (FIG. 2) is provided at the bottom of housing 60 and is sealed to the lower edge of the housing by means of continuous soldering therearound. Extending downwardly from base plate assembly 100 are three terminals 110, 112, and 114. Terminal 110 is for a common connection, terminal 112 is for a normally open connection, and terminal 114 is for a normally closed connection. Tubes 120 and 122 also extending downwardly from base plate assembly 100 are provided for flushing and evacuation of air from housing 60 after construction of switch 50 and for the subsequent filling of the housing with inert nitrogen gas. Tubes 120 and 122 are crimped off after the evacuation and filling operation and are of no further use.

Figure 4:
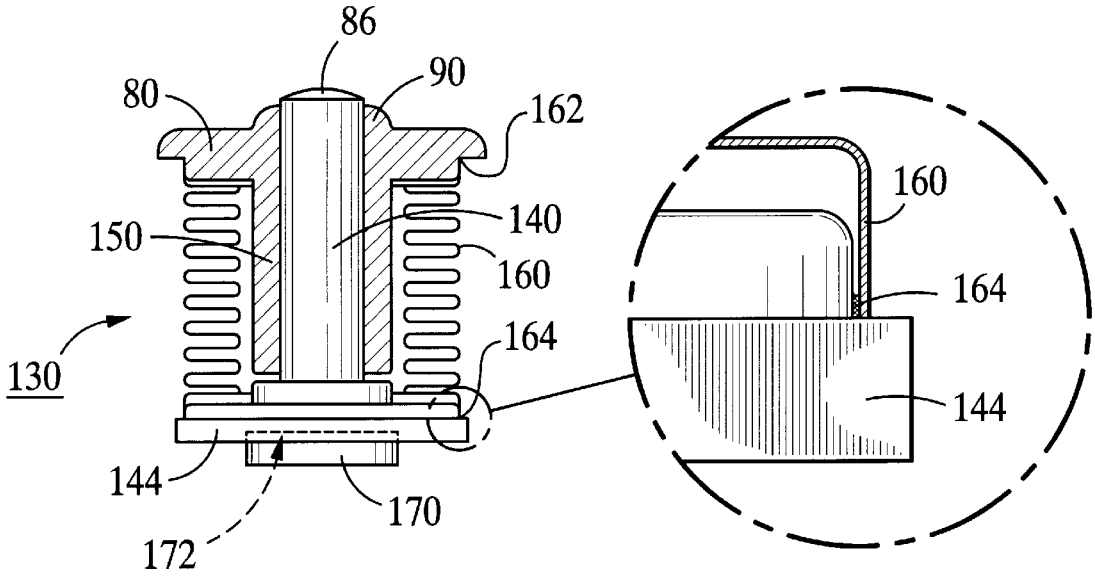
FIG. 4 is a fragmentary, side elevational view, partially in cross-section, of the bellows assembly portion of the switch of FIG. 2.

FIG. 4 illustrates a bellows seal of the present invention, generally indicated by the reference numeral 130.

More clearly shown on FIG. 4 are cover plate 80, actuation button 86 and overtravel stop 90, all as described with reference to FIGS. 2 and 3. As seen on FIG. 4, actuation button 86 is actually the top of a cylindrical nickel-silver post 140, the lower end of which post comprises a three-tiered nickel-silver base member 144. Post 140 is guided in up and down movement by means of a cylindrical portion 150 formed integrally with and depending from the upper portion of cover plate 80. A bellows 160 concentrically surrounding cylindrical portion 150 is sealed to cover plate 80 and to base member 144 by means of soldering continuously thereabout at, respectively, 162 and 164. Cover plate 80 covers the open end of bellows 160, while permitting communication of the internal volume of the bellows with the surrounding environment. A horizontal ceramic insulator 170 is inserted in a counterbore 172 defined in the lower surface of base member 144 and is attached to the base member by brazing.

Figure 5:
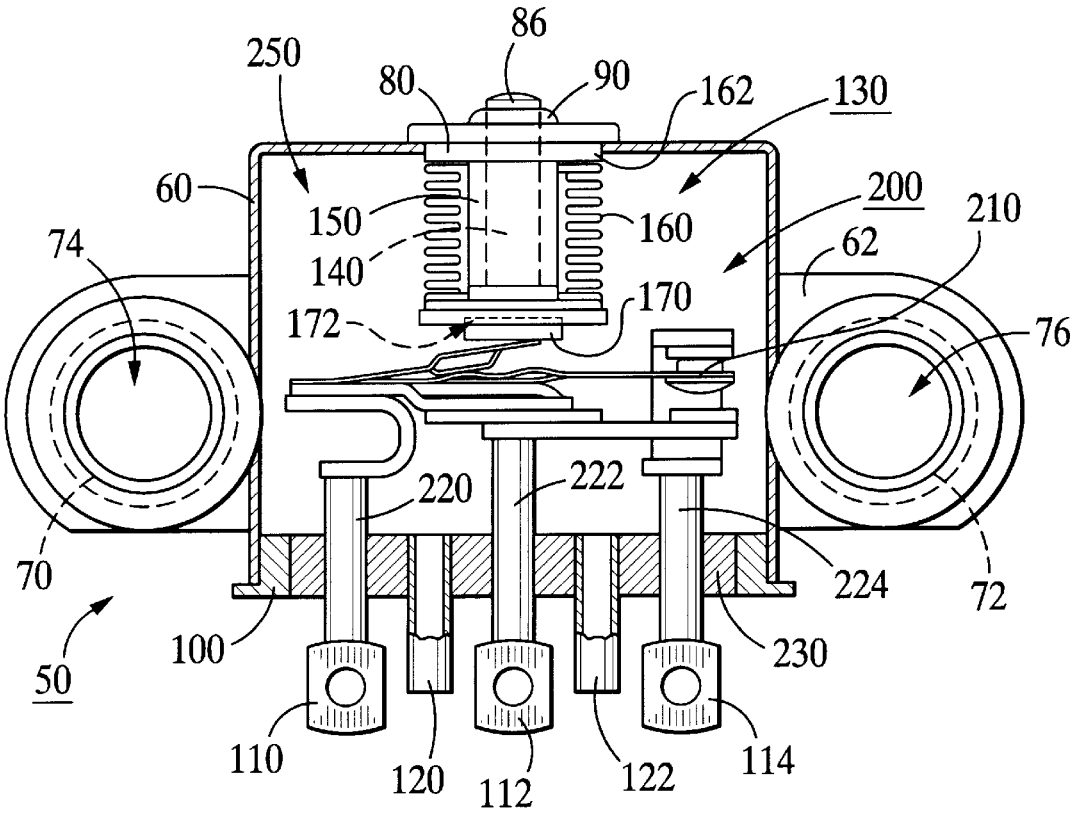
FIG. 5 is a side elevational view, partially in cross-section and partially cut-away, of the switch of FIG. 2.

FIG. 5 illustrates switch 50 and shows a switching mechanism, generally indicated by the reference numeral 200. Switching mechanism 200 is shown as a single pole, double throw, momentary contact switch, the same as switching mechanism 40 (FIG. 1). However, switching mechanism 200 is shown as an example only and any suitable switching mechanism can be employed with the present invention, the particular one employed not comprising part of the present invention. In the example shown, depression of actuation button 86 downwardly causes bellows 160 to expand, pressing insulator 170 against switch mechanism 200. This, in turn, causes a contactor element 210 to move from a position connecting common terminal 110 to normally closed terminal 114, as shown on FIG. 5, to a position in which the contactor element connects the common terminal to normally open terminal 112. When pressure on contactor button 86 is released, bellows 160 contracts, causing contactor element 210 to resume the position shown on FIG. 5.

Base plate 100 is fabricated from Kovar, a cobalt-steel material having a low temperature coefficient of expansion, as are terminal posts 220, 222, and 224. Glass seals, as at 230, having a similar temperature coefficient of expansion, are provided to seal terminal posts 220, 222, and 224 and tubes 120 and 122 to base plate 100. These materials are employed in conventional switches, such as switch 20 (FIG. 1).

It can be seen that internal volume 250 of switch 50 is completely and hermetically sealed from the interior of bellows 160, the interior of the bellows being the only volume that is in communication with the surrounding environment.

It has been found that a switch constructed according to the present invention and having gold alloy electrical contacts can experience as many as one million switchings before mechanical failure and meets MIL-S-8805, Enclosure 5.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "upper", "lower", "inner", "outer", "inwardly", "outwardly", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A hermetically sealed electrical switch, comprising:

(a) a housing;

(b) a bellows having a closed end and an open end, with said open end sealingly attached to said housing such that a first volume defined by interior surfaces of said housing and exterior surfaces of said bellows is hermetically sealed from external environment and such that a second volume defined at least in part by interior surfaces of said bellows is in communication with said external environment;

(c) switching means disposed in said first volume;

(d) switch actuator means at least partially disposed in said second volume;

(e) wherein depression of said switch actuator means against said closed end of said bellows causes said closed end of said bellows to press against and actuate said switching means; and (f) wherein no element other than said bellows causes said switch actuator means to return from an actuating position to a non-actuating position.

2. A hermetically sealed electrical switch, as defined in claim 1, wherein: said switch actuator means comprises a post disposed coaxially with said bellows, a first end of said post engaging said closed end of said bellows.

3. A hermetically sealed electrical switch, as defined in claim 2, wherein: said open end of said bellows is covered by a cover plate having an opening through which a second end of said post extends, said second end being depressible to actuate said switching means.

4. A hermetically sealed electrical switch, as defined in claim 3, further comprising: an annular overtravel stop disposed on said cover plate and surrounding said second end of said post to limit the degree to which said post may be depressed.

5. A hermetically sealed electrical switch, as defined in claim 3, wherein: said open end of said bellows is hermetically sealed to said cover plate and said cover plate is hermetically sealed to said housing.

6. A hermetically sealed electrical switch, as defined in claim 3, further comprising: a cylindrical guide member attached to said cover plate and surrounding said post to guide movement of said post.

7. A hermetically sealed electrical switch, as defined in claim 2, further comprising:

(a) a base member hermetically sealed to said bellows; and (b) said post is fixedly attached to a surface of said base member in said second volume.

8. A hermetically sealed electrical switch, as defined in claim 7, wherein: a surface of said base member in said first volume has fixedly attached thereto an insulating member and said insulating member engages said switching means to activate said switching means when said post is depressed.

9. A hermetically sealed electrical switch, as defined in claim 1, wherein: said closed end of said bellows is closed with a base member hermetically sealed to said bellows.

10. A hermetically sealed electrical switch, as defined in claim 1, wherein: said bellows is formed of nickel.

11. A hermetically sealed electrical switch, as defined in claim 1, wherein:

(a) said open end of said bellows is covered with a cover plate;

(b) said closed end of said bellows is closed with a base member; and (c) said bellows is hermetically sealed to said cover plate and said base member by soldering.

12. A hermetically sealed electrical switch, as defined in claim 1, wherein: said hermetically sealed electrical switch has a leak rate of no greater than $1\times10^{-8}$ atm.cc/sec.

13. A hermetically sealed electrical switch, comprising:

(a) a housing;

(b) a bellows having a closed end and an open end, with said open end sealingly attached to said housing such that a first volume defined by interior surfaces of said housing and exterior surfaces of said bellows is hermetically sealed from external environment and such that a second volume defined at least in part by interior surfaces of said bellows is in communication with said external environment;

(c) switching means disposed in said first volume;

(d) switch actuator means at least partially disposed in said second volume, said switch actuator means comprising a post disposed coaxially with said bellows, a first end of said post engaging said closed end of said bellows; and (e) wherein depression of said switch actuator means against said closed end of said bellows causes said closed end of said bellows to press against and actuate said switching means;

and said hermetically sealed electrical switch further comprising:

(f) a base member hermetically sealed to said bellows; and (g) said post being fixedly attached to a surface of said base member in said second volume.

* * * * *